US011754963B2

(12) United States Patent
Arasawa

(10) Patent No.: US 11,754,963 B2
(45) Date of Patent: Sep. 12, 2023

(54) IMAGE FORMING APPARATUS

(71) Applicant: Shinichi Arasawa, Kanagawa (JP)

(72) Inventor: Shinichi Arasawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/741,442

(22) Filed: May 11, 2022

(65) Prior Publication Data

US 2022/0373959 A1 Nov. 24, 2022

(30) Foreign Application Priority Data

May 20, 2021 (JP) ..... 2021-085398

(51) Int. Cl.
*G03G 21/16* (2006.01)
*G03G 21/18* (2006.01)

(52) U.S. Cl.
CPC ..... *G03G 21/1619* (2013.01); *G03G 21/1647* (2013.01); *G03G 21/1821* (2013.01); *G03G 2221/163* (2013.01); *G03G 2221/1639* (2013.01); *G03G 2221/1684* (2013.01)

(58) Field of Classification Search
CPC ..... G03G 21/1619; G03G 21/1647; G03G 21/1817; G03G 21/1821; G03G 2221/163; G03G 2221/1639; G03G 2221/1684
See application file for complete search history.

(56) References Cited

U.S. PATENT DOCUMENTS

| | | | | |
|---|---|---|---|---|
| 11,079,716 | B2 * | 8/2021 | Abe | |
| 2011/0052255 | A1 | 3/2011 | Yoshida et al. | |
| 2013/0136465 | A1 | 5/2013 | Yoshida et al. | |
| 2015/0125180 | A1 * | 5/2015 | Mori | G03G 21/1821 399/113 |
| 2016/0109827 | A1 | 4/2016 | Yoshida et al. | |
| 2018/0253032 | A1 | 9/2018 | Yoshida et al. | |
| 2018/0267430 | A1 | 9/2018 | Kita et al. | |
| 2019/0179237 | A1 | 6/2019 | Kita et al. | |
| 2019/0258191 | A1 | 8/2019 | Yoshida et al. | |

(Continued)

FOREIGN PATENT DOCUMENTS

| | | |
|---|---|---|
| JP | 2000-056631 | 2/2000 |
| JP | 2010-072307 | 4/2010 |
| JP | 2010-170010 | 8/2010 |

*Primary Examiner* — Sophia S Chen
(74) *Attorney, Agent, or Firm* — XSENSUS LLP

(57) ABSTRACT

An image forming apparatus includes an attaching and detaching unit, an attached and detached section, and a pressing member. The attaching and detaching unit includes a developing device including a developer bearer to develop a latent image on a latent image bearer and is detachably attached to the attached and detached section. The attached and detached section includes the latent image bearer, a main reference portion, and a sub-reference portion. The main reference portion contacts a main reference part of the attaching and detaching unit. The sub-reference portion contacts a sub-reference part of the attaching and detaching unit. The pressing member presses the attaching and detaching unit to generate a biasing force biasing the developer bearer toward the latent image bearer and a rotational moment toward the sub-reference portion of the attached and detached section around the main reference part with respect to the attaching and detaching unit.

14 Claims, 4 Drawing Sheets

(56) References Cited

U.S. PATENT DOCUMENTS

| | | | | |
|---|---|---|---|---|
| 2019/0286011 | A1 | 9/2019 | Nieda et al. | |
| 2020/0133164 | A1 | 4/2020 | Yoshida et al. | |
| 2020/0150585 | A1* | 5/2020 | Sato | G03G 21/1821 |
| 2020/0310340 | A1* | 10/2020 | Itabashi | |
| 2021/0041805 | A1 | 2/2021 | Nieda et al. | |
| 2021/0116843 | A1 | 4/2021 | Yoshida et al. | |
| 2021/0397121 | A1* | 12/2021 | Uohashi | G03G 21/1821 |
| 2022/0244676 | A1* | 8/2022 | Hatano | |

* cited by examiner

IMAGE FORMING APPARATUS

CROSS-REFERENCE TO RELATED APPLICATION

This patent application is based on and claims priority pursuant to 35 U.S.C. § 119(a) to Japanese Patent Application No. 2021-085398, filed on May 20, 2021, in the Japan Patent Office, the entire disclosure of which is hereby incorporated by reference herein.

BACKGROUND

Technical Field

Embodiments of the present disclosure relate to an image forming apparatus.

Related Art

In the related art, an image forming apparatus includes an attached and detached section and an attaching and detaching unit that is detachably attached to an attached and detached section. For example, a developing device is disposed in the attaching and detaching unit, and a latent image bearer is disposed in the attached and detached section. The developing device develops a latent image on the latent image bearer with developer borne on a developer bearer disposed in the developing device.

SUMMARY

In an embodiment of the present disclosure, there is provided an image forming apparatus that includes an attaching and detaching unit, an attached and detached section, and a pressing member. The attaching and detaching unit includes a developing device to develop a latent image on a latent image bearer with developer borne on a developer bearer of the developing device and is detachably attached to the attached and detached section. The attached and detached section includes the latent image bearer, a main reference portion, and a sub-reference portion. The main reference portion contacts a main reference part of the attaching and detaching unit to position the attaching and detaching unit. The sub-reference portion contacts a sub-reference part of the attaching and detaching unit to receive a rotation of the attaching and detaching unit around the main reference part. The pressing member presses the attaching and detaching unit to generate a biasing force biasing the developer bearer toward the latent image bearer and a rotational moment toward the sub-reference portion of the attached and detached section around the main reference part with respect to the attaching and detaching unit.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
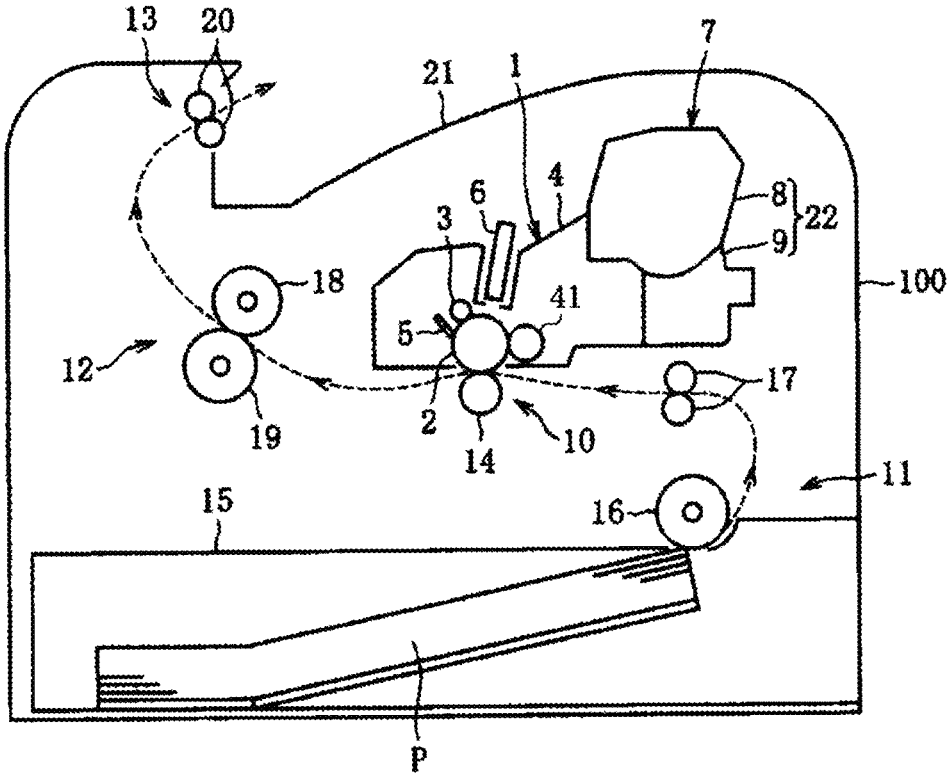
FIG. 1 is a schematic view of an image forming apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

A description is given below of an electrophotographic monochrome image forming apparatus 100 serving as an image forming apparatus according to an embodiment of the present disclosure. First, a basic configuration of the image forming apparatus 100 is described below. FIG. 1 is a schematic view of the image forming apparatus 100 according to an embodiment of the present disclosure. As illustrated in FIG. 1, the image forming apparatus 100 is a monochrome image forming apparatus. A process unit 1 as an image forming unit is detachably attached to an apparatus body (a body of the image forming apparatus 100).

The process unit 1 includes a photoconductor 2 as a latent image bearer to bear images on a surface of the photoconductor 2, a charging roller 3 as a charger to charge the surface of the photoconductor 2, and a cleaning blade 5 as a cleaner to clean the surface of the photoconductor 2. The process unit 1 further includes a light-emitting diode (LED) head array 6 as an exposure device to expose the surface of the photoconductor 2 at a position facing the photoconductor 2. The process unit 1 still further includes a developing unit 4 as a developing device to visualize a latent image on the photoconductor 2. In the present embodiment, the process unit 1 is an attached and detached section, and the developing unit 4 is an attaching and detaching unit.

A toner cartridge 7 (toner container) serving as a developer container is detachably attached to the apparatus body of the image forming apparatus 100 according to the present embodiment. The toner cartridge 7 includes a container body 22. The container body 22 includes a developer housing portion 8 serving as a toner housing that stores toner serving as developer to be supplied to the developing unit 4 and a developer collecting portion 9 serving as a waste-toner housing portion that collects toner (waste toner) removed by the cleaning blade 5.

The body of the image forming apparatus 100 includes a transfer device 10, a sheet feeder 11, a fixing device 12, and a sheet ejection device 13. The transfer device 10 transfers an image onto a sheet as a recording medium. The sheet feeder 11 supplies a sheet. The fixing device 12 fixes the image transferred onto the sheet. The sheet ejection device 13 ejects the sheet to the outside of the apparatus.

The transfer device 10 includes a transfer roller 14 as a transferor. The transfer roller 14 contacts the photoconductor 2. A transfer nip is formed at a contact area between the transfer roller 14 and the photoconductor 2. The transfer roller 14 is connected to a power supply that applies at least one of a predetermined direct current (DC) voltage and a predetermined alternating current (AC) voltage to the transfer roller 14.

The sheet feeder 11 includes a sheet tray 15 and a feed roller 16. The sheet tray 15 stacks sheets P. The feed roller 16 feeds the sheets P stacked in the sheet tray 15. A registration roller pair 17 is disposed downstream from the feed roller 16 in a sheet conveying direction. The registration roller pair 17 functions as a timing roller to convey the sheet P to the transfer nip at a proper timing of conveyance of the sheet P. It is to be noted that the sheets P may be thick paper, postcards, envelopes, plain paper, thin paper, coated paper, art paper, tracing paper, and the like. Additionally, overhead projector (OHP) transparency (OHP sheet or OHP film) or cloth may be used as a recording medium other than paper.

The fixing device 12 includes a fixing roller 18 serving as a fixing rotator and a pressure roller 19 serving as a pressure rotator. The fixing roller 18 is heated by a heating source such as a heater. The pressure roller 19 is pressed against and contacts the fixing roller 18 to form a fixing nip in an area of contact between the fixing roller 18 and the pressure roller 19.

The sheet ejection device 13 includes an output roller pair 20. The sheet ejected to the outside of the apparatus by the output roller pair 20 is stacked on an output tray 21 formed by recessing an upper surface of the apparatus body.

Next, image forming operations of the image forming apparatus 100 according to the present embodiment are described below. As an image formation starts, the photoconductor 2 is driven to rotate. The charging roller 3 uniformly charges an outer circumferential surface of the photoconductor 2 at a predetermined polarity. The light-emitting diode (LED) head array 6 exposes the charged surface of the photoconductor 2 based on image data from a reading device or a computer to form an electrostatic latent image. The electrostatic latent image formed on the photoconductor 2 is developed into a toner image (a visible image) with toner supplied by a developing roller 41 as a developer bearer of the developing unit 4.

As the image formation starts, the feed roller 16 starts rotating to feed the sheet P from the sheet tray 15 toward the registration roller pair 17. The registration roller pair 17 temporarily stops the sheet P fed by the feed roller 16. After that, a rotation of the registration roller pair 17 is started at a predetermined timing, and the sheet P is conveyed to the transfer nip in accordance with the timing at which the toner image on the photoconductor 2 reaches the transfer nip.

At this time, a transfer voltage having a polarity opposite a polarity of the charged toner contained in the toner image formed on the photoconductor 2 is applied to the transfer roller 14, thereby generating a transfer electric field in a transfer area. The toner image on the photoconductor 2 is transferred onto the sheet P by the transfer electric field. After the transfer process, the cleaning blade 5 removes residual toner, which failed to be transferred onto the sheet P, remaining on the photoconductor 2. Thus, the removed toner is conveyed to and collected in the developer collecting portion 9 in the toner cartridge 7.

After the toner image is transferred onto the sheet P, the sheet P bearing the toner image is conveyed to the fixing device 12. The fixing device 12 fixes the toner image onto the sheet P under heat and pressure while the sheet P is conveyed through the fixing nip formed between the fixing roller 18 and the pressure roller 19. The sheets P are ejected to the outside of the apparatus by the output roller pair 20 and are stacked on the output tray 21.

Figure 2:
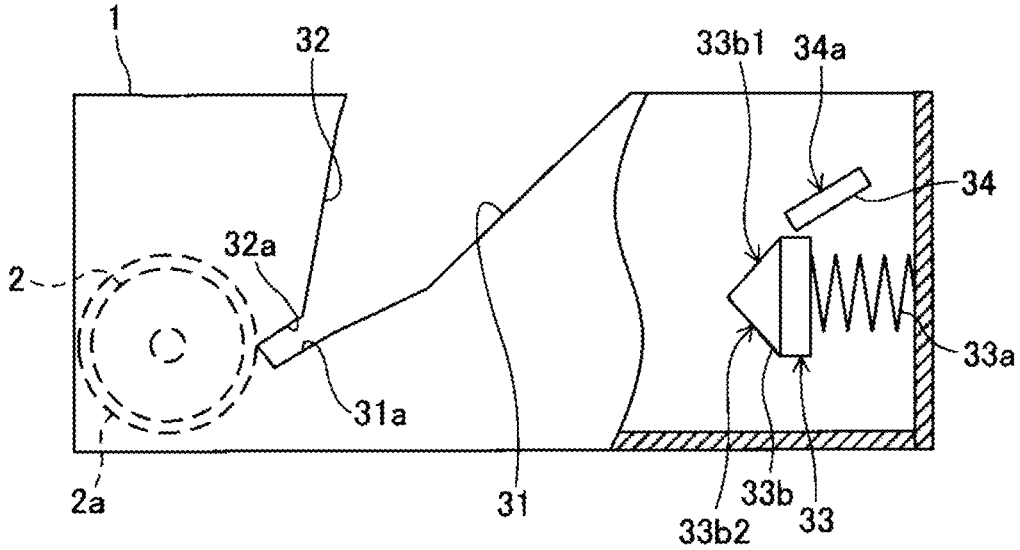
FIG. 2 is a diagram illustrating a configuration of a process unit to which a developing unit is detachably attached in the image forming apparatus in FIG. 1.
Figure 3:
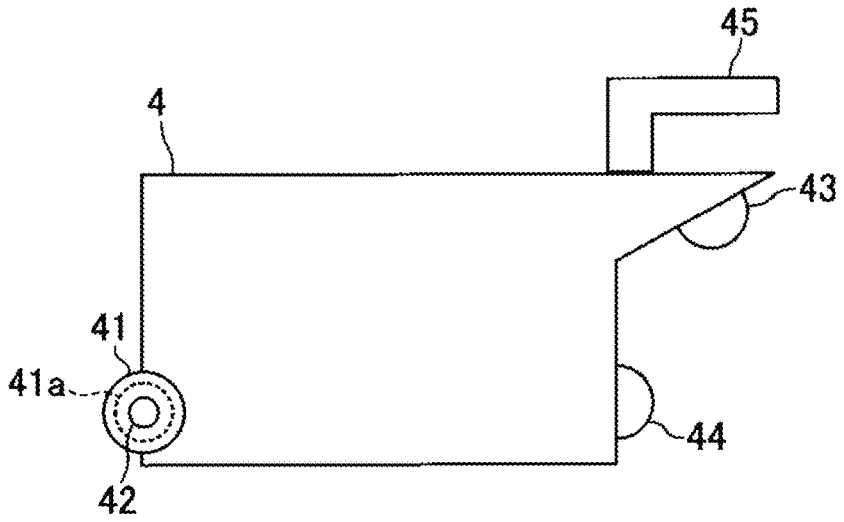
FIG. 3 is a schematic view of the developing unit detachably attached to the process unit in FIG. 2.

Next, a description is given of the developing unit 4 attached to and detached from the apparatus body according to the present embodiment. FIG. 2 is a diagram illustrating a configuration of the process unit 1 to which the developing unit 4 is detachably attached. FIG. 3 is a diagram illustrating a configuration of the developing unit 4 detachably attached to the process unit 1.

A housing of the process unit 1 according to the present embodiment includes guide rails 31 and 32 on both end surfaces (side surfaces) in an axial direction of the photoconductor 2. The guide rails 31 and 32 guide a guided portion of the developing unit 4 during attachment or detachment of the developing unit 4. The guided portions of the developing unit 4 in the present embodiment are main reference shafts 42 as main reference parts for positioning the developing unit 4 with respect to the process unit 1. The guide rails 31 and 32 of the process unit 1 include main reference surfaces 31*a* and 32*a* as main reference portions that contact the main reference shafts 42 of the developing unit 4 to position the developing unit 4 at a target position of the process unit 1.

The process unit 1 includes a sub-reference member 43 that forms a sub-reference surface 34*a* on positioner 34 in order to stably position the developing unit 4. The process unit 1 includes a pressing member 33 that presses the developing unit 4 in order to generate a biasing force for biasing the developing roller 41 of the developing unit 4 toward the photoconductor 2 of the process unit 1. The pressing member 33 presses a pressed portion 44 of the developing unit 4 with the biasing force of a spring 33*a* by a pressing portion 33*b* to generate the biasing force for biasing the developing roller 41 toward the photoconductor 2.

The developing unit 4 includes a driven gear 41*a* on a rotational shaft of the developing roller 41. The driven gear 41*a* meshes with a drive gear 2*a* disposed on a rotational shaft of the photoconductor 2 in the process unit 1. When the developing unit 4 is positioned with respect to the process unit 1, the drive gear 2*a* and the driven gear 41*a* mesh with each other. Thus, the developing roller 41 is driven to rotate in accordance with the rotational drive of the photoconductor 2.

The main reference shafts 42 are disposed coaxially with the rotation shaft of the developing roller 41 disposed in the developing unit 4. The main reference shafts 42 protrude outward in the axial direction from the roller ends of the developing roller 41. A housing of the developing unit 4 is provided with the sub-reference member 43 serving as a sub-reference part that contacts the sub-reference surface 34*a* of the process unit 1. The housing of the developing unit 4 is provided with the pressed portion 44 that contacts the pressing portion 33*b* of the pressing member 33 of the process unit 1 and receives the pressing force. The housing of the developing unit 4 is also provided with a handle 45 to be gripped by an operator when the developing unit 4 is attached to or detached from the process unit 1.

Figure 4:
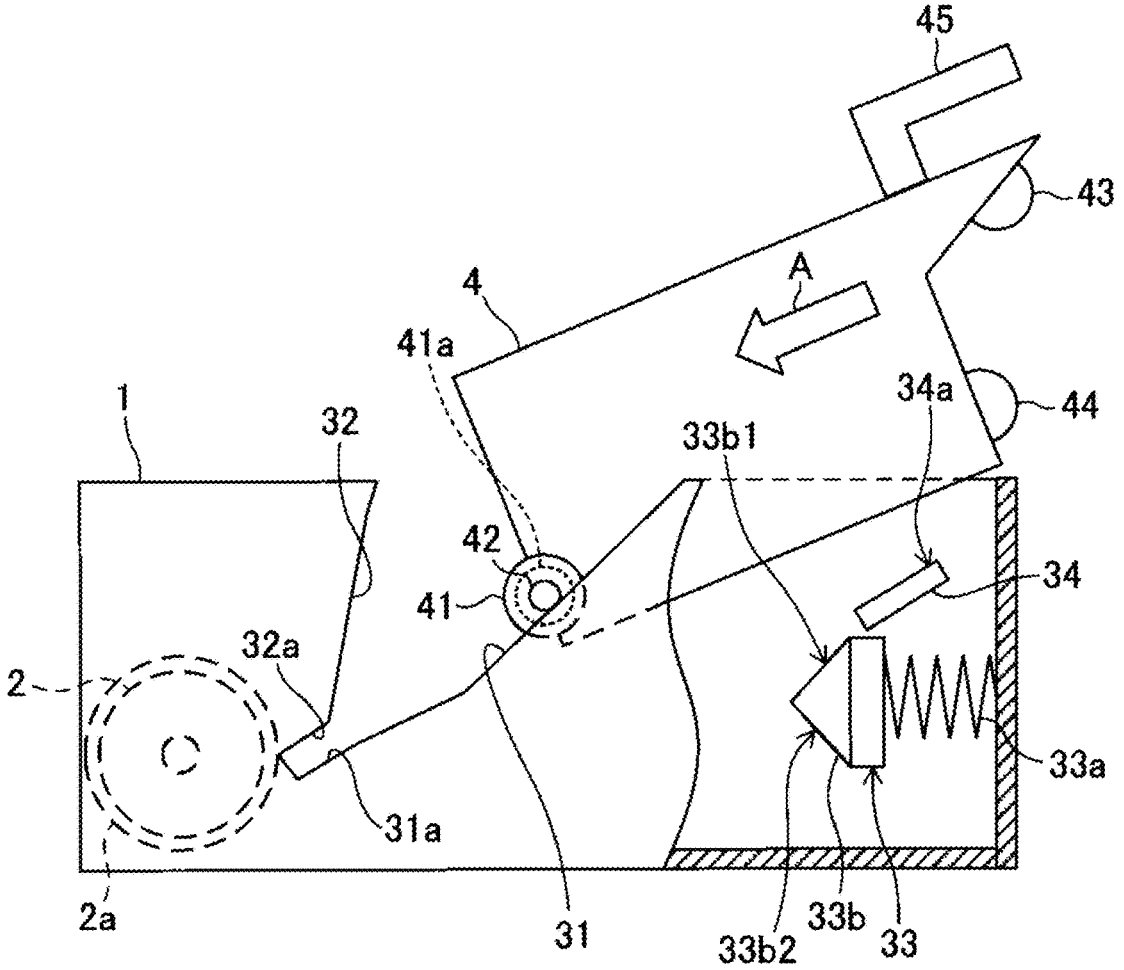
FIG. 4 is a schematic view of the developing unit being inserted into the process unit in FIG. 2.

With reference to FIGS. 4 to 7, a description is given of attaching the developing unit 4 to the process unit 1. When the developing unit 4 is attached to the process unit 1, first, the operator grips the handle 45 of the developing unit 4 and inserts the developing unit 4 into the process unit 1 from above the process unit 1 along a direction indicated by a white arrow A in FIG. 4. At this time, the operator places the main reference shafts 42, which are disposed on the side surfaces (end surfaces in the direction perpendicular to the plane on which FIG. 4 is illustrated) of the developing unit 4, onto the lower guide rail 31 and slides the main reference shafts 42 along the lower guide rail 31 to insert the developing unit 4 into the process unit 1.

Since the lower guide rail 31 of the process unit 1 is inclined downward in an insertion direction of the developing unit 4 as illustrated in FIG. 4, the developing unit 4 can be slid by its own weight even if the operator does not push the developing unit 4 in the insertion direction. The main reference shaft 42 in the present embodiment is a columnar member. Accordingly, even if any position on the circumferential surface of the main reference shaft 42 contacts the lower guide rail 31, the main reference shaft 42 substantially contacts the lower guide rail 31 at a point. Since the contact area is small, the frictional force is small, and a smooth sliding operation (insertion operation) is performed.

Figure 5:
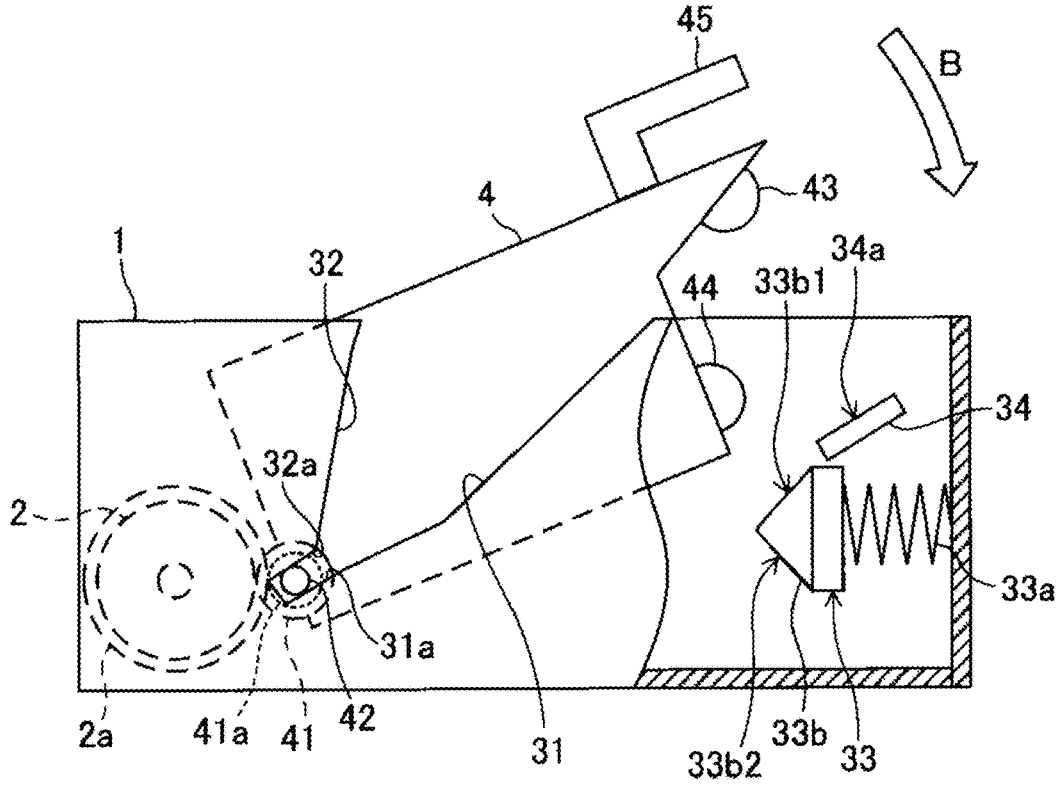
FIG. 5 is a schematic view of the developing unit inserted deep into the process unit, subsequent to the state illustrated in FIG. 4.

As illustrated in FIG. 5, when the developing unit 4 is inserted deep into the process unit 1, the developing roller 41 of the developing unit 4 contacts the photoconductor 2 of the process unit 1 (i.e., a usage state). At this time, the driven gear 41*a* disposed on the rotational shaft of the developing roller 41 of the developing unit 4 meshes with the drive gear 2*a* disposed on the rotational axis of the photoconductor 2 of the process unit 1.

When the developing unit 4 is inserted into the process unit 1 and the developing roller 41 contacts the photoconductor 2, the developing unit 4 cannot be further inserted. As a result, each main reference shaft 42 of the developing unit 4 is inserted to a predetermined position of the guide rails 31 and 32 of the process unit 1. At this predetermined position, each main reference shaft 42 is fitted with a slight clearance between a part (main reference surface 31*a*) of the lower guide rail 31 and a part (main reference surfaces 32*a*) of the upper guide rail 32. Thus, the positioning of the main reference of the developing unit 4 with respect to the process unit 1 is completed. That is, the part (main reference surface) 31*a* of the lower guide rail 31 and the part (main reference surface) 32*a* of the upper guide rail 32 into which the main reference shaft 42 is fitted serve as main reference surfaces in the present embodiment.

As described above, in the present embodiment, the parts of the guide rails 31 and 32 serve as the main reference surfaces 31*a* and 32*a*. For this reason, the main reference shafts 42 that have slid on the lower guide rails 31 slide to the positions (predetermined positions) of the main reference surfaces 31*a* and 32*a* and reach the main reference surfaces 31*a* and 32*a*. The positioning of the main reference of the developing unit 4 with respect to the process unit 1 is completed.

If the main reference surface is located at a position different from a position of the guide rail, an operation for separating (lifting) the guided portion from the guide rail is necessary so that the main reference shaft, which may be the same as or different from the guided portion guided by the guide rail, contacts (or is placed on) the main reference surface. This is because the main reference cannot be positioned by contact between the main reference surface and the main reference shaft unless the guided portion is separated from the guide rail. In this case, a two-step operation of sliding the guided portion with respect to the guide rail and then separating the guided portion from the guide rail is necessary, which impairs the convenience of the operator.

In contrast, according to the present embodiment, the positioning of the main reference of the developing unit 4 with respect to the process unit 1 is completed only by inserting the developing unit 4 into the process unit 1. Accordingly, the convenience of the operator is high.

When the positioning of the main reference is completed as described above, next, as illustrated in FIG. 5, the operator rotates the developing unit 4 around the main reference shaft 42 in a direction indicated by white arrow B in FIG. 5. At this time, since a rotational force in a direction indicated by a white arrow B in FIG. 5 is applied to the developing unit 4 by the rotational moment due to its own weight, the operator only needs to weaken the force for supporting the handle 45 of the developing unit 4 from below.

Figure 6:
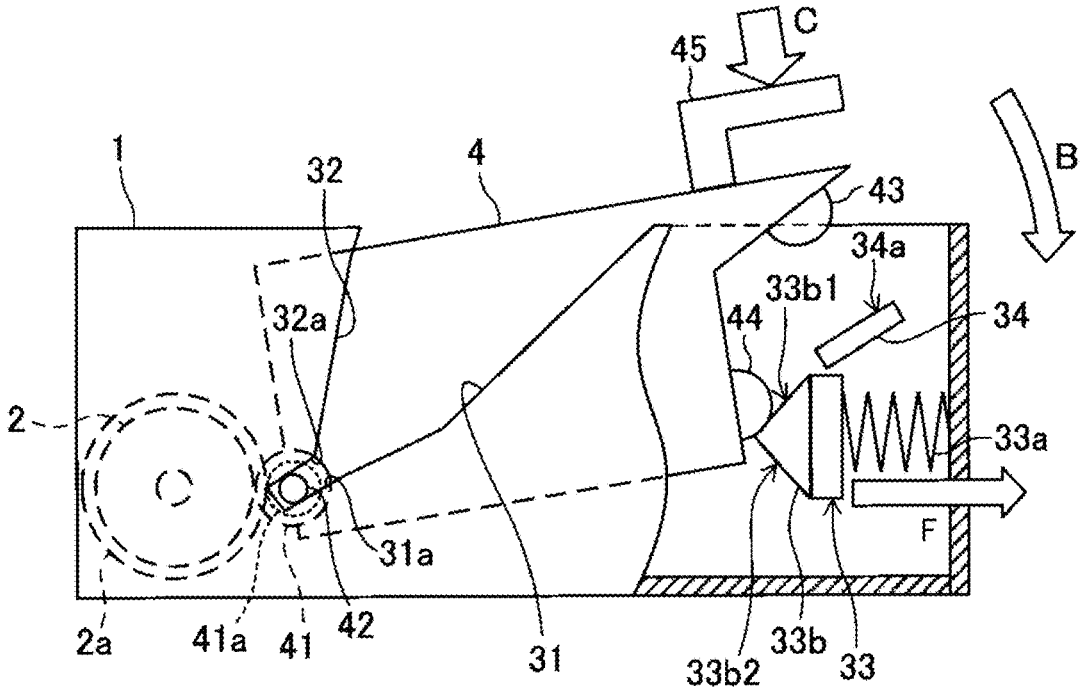
FIG. 6 is a schematic view of the developing unit being rotated and attached to the process unit, subsequent to the state illustrated in FIG. 5.

As illustrated in FIG. 6, when the developing unit 4 rotates around the main reference shafts 42, the pressed portion 44 of the developing unit 4 contacts an upper surface 33*b*1 of the pressing portion 33*b* of the pressing member 33 of the process unit 1. As illustrated in FIG. 6, the upper surface 33*b*1 of the pressing portion 33*b* of the present embodiment has an inclined surface. A part of the biasing force of the spring 33*a* of the pressing member 33 acts as a force against the force with which the self-weight of the developing unit 4 pushes down the pressing portion 33*b*. As a result, in the present embodiment, the pressing portion 33*b* of the pressing member 33 cannot be pushed away against the biasing force of the spring 33*a* only by the self-weight of the developing unit 4. The pressed portion 44 of the developing unit 4 stays on the upper surface 33*b*1 of the pressing portion 33*b*.

From the above-described state, the operator presses down the handle 45 of the developing unit 4 as indicated by an arrow C in FIG. 6, so that the pressing portion 33*b* of the pressing member 33 can be pushed in a direction indicated by an arrow F in FIG. 6 against the biasing force of the spring 33*a*. Thus, the pressed portion 44 of the developing unit 4 can pass a top of the pressing portion 33*b*. The developing unit 4 can be further rotated in the direction of an arrow B in FIG. 6.

Figure 7:
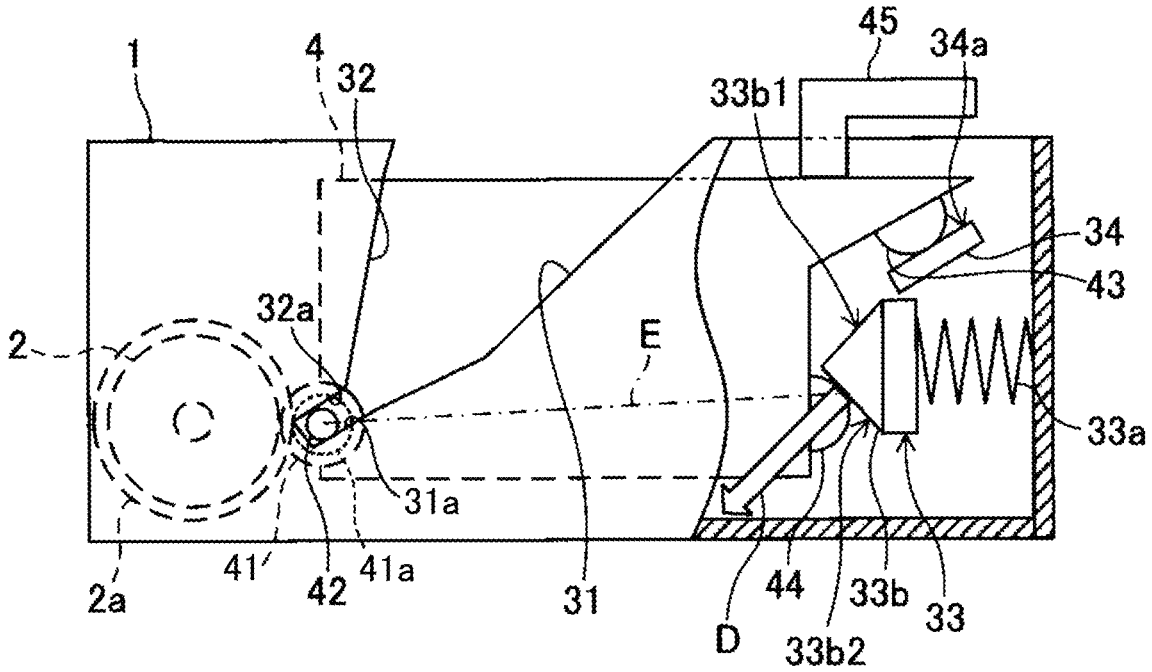
FIG. 7 is a view of the developing unit fully attached to the process unit, subsequent to the state illustrated in FIG. 6.

With such a configuration, the developing unit 4 is further rotated in the direction indicated by the arrow B in FIG. 6, so that the sub-reference member 43 of the developing unit 4 contacts the sub-reference surface 34*a* of the process unit 1 as illustrated in FIG. 7. Accordingly, the rotation of the developing unit 4 around the main reference shafts 42 is received by the sub-reference surface 34*a*. Thus, the positioning of the sub-reference of the developing unit 4 with respect to the process unit 1 is completed. As a result, the position of the main reference shaft 42 of the developing unit 4, which is the rotational shaft with respect to the process unit 1, is positioned by the main reference surfaces 31*a* and 32*a*. Further, the rotational position with respect to the process unit 1 is positioned by the sub-reference surface 34*a*. Thus, the developing unit 4 is positioned with respect to the process unit 1.

At this time, since the sub-reference member 43 of the developing unit 4 that abuts against the sub-reference surface 34*a* of the process unit 1 is a spherical surface or a curved surface, the sub-reference member 43 can substantially contact the sub-reference surface 34*a* at a point and can abut against the sub-reference surface 34*a* without rattling.

When the sub-reference member 43 of the developing unit 4 contacts the sub-reference surface 34*a* of the process unit 1, the pressed portion 44 of the developing unit 4 contacts a lower surface 33*b*2 of the pressing portion 33*b* as illustrated in FIG. 7. As illustrated in FIG. 7, the lower surface 33*b*2 of the pressing portion 33*b* of the present embodiment is an inclined surface. A part of the biasing force of the spring 33*a* of the pressing member 33 acts as a force for biasing the pressed portion 44 of the developing unit 4 in a direction indicated by an arrow D in FIG. 7.

The pressing member 33 presses the developing unit 4 in this manner, so that the developing roller 41 of the developing unit 4 generates a biasing force to bias the developing roller 41 toward the photoconductor 2. Accordingly, even if some external force (i.e., an impact) is applied and a force acts to move the developing roller 41 in a direction away from the photoconductor 2, the developing roller 41 can be prevented from moving in the direction away from the photoconductor 2 by a pressing force of the pressing member 33 (the biasing force by the spring 33*a*). That is, the main reference shaft 42 of the developing unit 4 is prevented from moving in a pull-out direction (i.e., a direction opposite to an insertion direction) along the guide rails 31 and 32. As a result, the positioning of the main reference of the developing unit 4 with respect to the process unit 1 is stably maintained.

In particular, the sub-reference surface 34*a* in the present embodiment is substantially parallel to the main reference surfaces 31*a* and 32*a*. Thus, a slidable direction of the developing unit 4 is unified, and dispersion of the biasing force to bias the developing roller 41 toward the photoconductor 2 by the pressing force of the pressing member 33 is reduced.

Some external force (i.e., an impact) may be applied and cause a force acting in a direction to separate the sub-reference member 43 of the developing unit 4 from the sub-reference surface 34*a* of the process unit 1. In this case, the position of the developing unit 4 (the position of the sub-reference) with respect to the process unit 1 may deviate.

In the present embodiment, as illustrated in FIG. 7, when viewed from the axial direction of the developing roller 41 (the axial direction of the main reference shaft 42), a direction D of the pressing force of the pressing member 33 is directed downward from a straight line E (long dashed short dashed line) connecting the main reference shaft 42 and the contact portion between the pressing member 33 and the sub-reference member 43. That is, the pressing force of the pressing member 33 contains force components that cause the sub-reference member 43 of the developing unit 4 to generate a rotational moment around the main reference shaft 42 toward the sub-reference surface 34*a* of the process unit 1 with respect to the developing unit 4. Accordingly, a part of the pressing force of the pressing member 33 acts as a deterrent that prevents the sub-reference member 43 of the developing unit 4 from moving in a direction away from the sub-reference surface 34*a* of the process unit 1. Thus, the sub-reference positioning of the developing unit 4 with respect to the process unit 1 is also stably maintained.

Accordingly, a separate fixing member for preventing the developing unit 4 from rotating in a direction in which the sub-reference member 43 moves away from the sub-reference surface 34*a* can be omitted. If such a separate fixing member can be omitted, not only the configuration can be simplified, but also the work of operating the separate fixing member by the operator can be omitted, thereby further improving the convenience.

An angle formed by the direction D of the pressing force and the straight line E (long dashed short dashed line) is preferably within a range of 10° or more and 30° or less. If this angle is smaller than 10°, the force pressing the sub-reference member 43 against the sub-reference surface 34*a* may be insufficient. Thus, the positioning of the sub-reference of the developing unit 4 with respect to the process unit 1 may be unstable. On the other hand, if the angle is greater than 30°, the force required to pull up the handle 45 increases when the operator detaches the developing unit 4 from the process unit 1. Thus, convenience may deteriorate.

In the present embodiment, the pressing force of the pressing member 33 is set such that a force component parallel to the sub-reference surface 34*a* is larger than a force component that generates a rotational moment around the main reference shaft 42 described above. Specifically, the inclination angle of the lower surface 33*b*2 of the pressing portion 33*b* of the pressing member 33 and the shape of the pressed portion 44 of the developing unit 4 are determined so that such a pressing force is generated. Such a pressing force is generated with above-described configuration, so that a friction force between the sub-reference member 43 and the sub-reference surface 34*a* can be reduced. Thus, a sufficient biasing force for biasing the developing roller 41 of the developing unit 4 toward the photoconductor 2 can be ensured. As a result, the positioning of the main reference of the developing unit 4 with respect to the process unit 1 can be further stabilized.

In the present embodiment, as described above, the driven gear 41*a* disposed on the rotational shaft of the developing roller 41 meshes with the drive gear 2*a* disposed on the rotational shaft of the photoconductor 2, and the developing roller 41 is driven by the photoconductor 2. At this time, the direction of a pressure angle of the driven gear 41*a* is toward a direction in which the driven gear 41*a* is separated from the drive gear 2*a*. As a result, it is necessary to prevent the driven gear 41*a* from being displaced in a direction away from the drive gear 2*a* in order to maintain appropriate meshing even when the developing roller 41 is driven by the photoconductor 2.

However, the pressing force of the pressing member 33 may be set so as to prevent the driven gear 41*a* from being displaced in a direction away from the drive gear 2*a*. In this case, the force to stably maintain the positioning of the main reference and the sub-reference of the developing unit 4 with respect to the process unit 1 may be weakened.

When the driven gear 41*a* is displaced in a direction away from the drive gear 2*a* as the developing roller 41 is driven by the photoconductor 2, the developing unit 4 attempts to displace in the direction away from the photoconductor 2 in accordance with the displacement. However, in the present embodiment, the direction of the pressure angle of the driven gear 41*a* is substantially perpendicular (for example, in a range 90°±5°) to the main reference surface 31*a*. Accordingly, even if the main reference shaft 42 of the developing unit 4 is displaced in above-described direction, the main reference shaft 42 is blocked by the main reference surface 31*a* of the lower guide rail 31 of the process unit 1. Thus, the developing unit 4 cannot be displaced in above-described direction. As a result, when the developing roller 41 is driven by the photoconductor 2, the driven gear 41*a* is prevented from displacing in the direction away from the drive gear 2*a*.

Thus, appropriate meshing between the driven gear 41*a* and the drive gear 2*a* is maintained.

In the present embodiment, the attached and detached section is the process unit 1. However, in some embodiments, the attached and detached section may be an apparatus body of an image forming apparatus. The attaching and detaching unit according to the present embodiment is the developing unit 4. However, in some embodiments, the attaching and detaching unit may include a device or member other than the developing device.

The above-described embodiments are given as examples, and, for example, the following aspects of the present disclosure may have advantageous effects described below.

First Aspect

An image foaming apparatus in a first aspect is an image forming apparatus (such as the image forming apparatus 100) in which a developing device that develops a latent image on a latent image bearer (such as the photoconductor 2) disposed in an attached and detached section (such as the process unit 1) with developer borne on a developer bearer (such as the developing roller 41) is disposed in an attaching and detaching unit (such as a developing unit 4). The image forming apparatus includes a pressing member (such as the pressing member 33). The pressing member (such as the pressing member 33) presses the attaching and detaching unit to generate a biasing force biasing the developer bearer toward the latent image bearer. The attached and detached section includes a main reference portion (such as the main reference surfaces 31*a* and 32*a*) and a sub-reference portion (such as the sub-reference surface 34*a*). The main reference portion contacts a main reference part (such as the main reference shaft 42) of the attaching and detaching unit to position the attaching and detaching unit. The sub-reference portion contacts a sub-reference part (such as the sub-reference member 43) of the attaching and detaching unit to receive a rotation of attaching and detaching unit around the main reference part. A pressure of the pressing member generates a rotational moment toward the sub-reference portion around the main reference part with respect to the attaching and detaching unit. In an image forming apparatus of the related art, the pressing force of a pressing member that presses an attaching and detaching unit in order to generate the biasing force that biases a developer bearer toward a latent image bearer also serves as a deterrent force that prevents the attaching and detaching unit from moving in a direction away from an attached and detached section. Accordingly, a situation in which the attaching and detaching unit moves in a direction away from the attached and detached section and the position thereof is displaced is less likely to occur due to the pressing force of the pressing member. Thus, the stability of positioning of the attaching and detaching unit with respect to the attached and detached section is high. However, in such an image forming apparatus of the related art, the main reference and the sub-reference of the positioning of the attaching and detaching unit with respect to the attached and detached section have configurations in which projections are inserted into U-shaped groove portions. Accordingly, when the attaching and detaching unit is attached to the attached and detached section, the operator is forced to perform an operation of inserting the projection into the groove portion of the main reference and inserting the projection into the groove portion of the sub reference. This operation involves a complicated operation of simultaneously inserting the projections into both grooves, which is not convenient for the operator. On the other hand, in the first aspect, when the attaching and detaching unit is attached to the attached and detached section, first, the main reference part contacts the main reference portion to perform positioning of the main reference of the attaching and detaching unit with respect to the attached and detached section. After the positioning of the main reference is completed, the attaching and detaching unit is rotated around the main reference part so that the sub-reference part of the attaching and detaching unit contacts the sub-reference portion of the attached and detached section, thereby positioning the sub-reference. In this way, if the positioning of the sub-reference is performed after the positioning of the main reference, it is not necessary to perform the positioning of the sub-reference during the positioning of the main reference, and it is not necessary to perform the positioning of the main reference during the positioning of the sub-reference. Accordingly, the work is very simple and convenient for the operator. In the first aspect, the rotation moment around the main reference part toward the sub-reference portion with respect to the attaching and detaching unit is generated by the pressing of the pressing member that presses the attaching and detaching unit in order to generate the biasing force that biases the developer bearer toward the latent image bearer. Accordingly, a part of the pressing force of the pressing member serves as a deterrent force that prevents the sub-reference part of the attaching and detaching unit from moving in a direction away from the sub-reference portion of the attached and detached section. As a result, the stability of positioning of the attaching and detaching unit with respect to the attached and detached section is also high.

Second Aspect

In the image forming apparatus such as the image forming apparatus 100 according to the first aspect, the developer bearer such as the developing roller 41 includes a driven gear such as the driven gear 41*a* meshing with a drive gear such as the drive gear 2*a* disposed on the rotational shaft of the latent image bearer such as the photoconductor 2. According to this configuration, even in a case where the pressure angle of the driven gear 41*a* is directed in a direction in which the driven gear such as the driven gear 41*a* is separated from the drive gear such as the drive gear 2*a*, the driven gear is prevented from being separated from the drive gear due to the pressing force of the pressing member. As a result, appropriate meshing between the driven gear and the drive gear is maintained.

Third Aspect

In the image forming apparatus such as the image forming apparatus 100 according to the second aspect, a direction of the pressure angle of the driven gear such as the driven gear 41*a* is substantially perpendicular to a surface of the main reference portion such as the main reference surfaces 31*a* and 32*a*. According to this configuration, a movement of the driven gear away from the drive gear can be received by a surface of the main reference portion. As a result, appropriate meshing between the driven gear and the drive gear is maintained without weakening the action of the pressing force of the pressing member, which acts as a deterrent force that prevents the sub-reference part of the attaching and detaching unit from moving in a direction away from the sub-reference portion of the attached and detached section.

Fourth Aspect

In the image forming apparatus such as the image forming apparatus 100 according to any one of the first aspect to third aspect, the attached and detached section includes a guide rail such as the guide rails 31 and 32 that guides the main reference part during attachment and detachment of the attaching and detaching unit, and a part of the guide rail functions as the main reference portion. According to this configuration, the positioning of the main reference of the attaching and detaching unit with respect to the attached and detached section is completed only by performing the operation of moving the attaching and detaching unit along the guide rail, thus further improving the convenience of an operator.

Fifth Aspect

In the image forming apparatus such as the image forming apparatus 100 according to any one of the first aspect to fourth aspect, a surface of the sub-reference portion is substantially parallel to the main reference surface as a surface of the main reference portion. According to this configuration, a direction in which the attaching and detaching unit is movable is unified, thus reducing the dispersion of the biasing force by which the developer bearer is biased toward the latent image bearer by the pressing force of the pressing member.

Sixth Aspect

In the image forming apparatus such as the image forming apparatus 100 according to any one of the first aspect to fifth aspect, a force component parallel to the surface of the sub-reference portion of the pressing member is larger than a force component generating the rotation moment. According to this configuration, the frictional force between the sub-reference part and the sub-reference portion is reduced, thus ensuring a sufficient biasing force for biasing the developer bearer of the attaching and detaching unit toward the latent image bearer.

Seventh Aspect

In the image forming apparatus such as the image forming apparatus 100 according to any one of the first aspect to sixth aspect, a pressing direction such as the direction D of the pressing member is within a range of 10° or more and 30° or less with respect to a line such as the line E connecting a rotational shaft of the latent image bearer and a rotational shaft of the developer bearer when viewed from a rotational axis direction of the latent image bearer. If the angle is less than 10°, the force pressing the sub-reference part against the sub-reference portion is insufficient. Thus, the positioning of the sub-reference of the attaching and detaching unit with respect to the attached and detached section may be unstable. If the angle is greater than 30°, the force required for the operator to detach the attaching and detaching unit from the attached and detached section increases, and convenience may be deteriorated.

Eighth Aspect

In the image forming apparatus such as the image forming apparatus 100 according to any one of the first aspect to seventh aspect, the sub-reference part has a curved surface. According to this configuration, the sub-reference part can substantially point-contact the sub-reference portion. Thus, the positioning stability of the attaching and detaching unit with respect to the attached and detached section can be enhanced by contacting without rattling.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An image forming apparatus comprising:

an attaching and detaching unit including a developing device configured to develop a latent image on a latent image bearer with developer borne on a developer bearer of the developing device;

an attached and detached section including the latent image bearer, the attaching and detaching unit being detachably attached to the attached and detached section, the attached and detached section including:

a main reference portion to contact a main reference part of the attaching and detaching unit to position the attaching and detaching unit; and a sub-reference portion to contact a sub-reference part of the attaching and detaching unit to receive a rotation of the attaching and detaching unit around the main reference part; and a pressing member configured to press the attaching and detaching unit to generate a biasing force biasing the developer bearer toward the latent image bearer and a rotational moment toward the sub-reference portion of the attached and detached section around the main reference part with respect to the attaching and detaching unit, wherein pressure of the pressing member against the attaching and detaching unit includes a force component generating the rotation moment and a force component parallel to a surface of the sub-reference portion, and wherein the force component parallel to the surface of the sub-reference portion is larger than the force component generating the rotation moment.

2. The image forming apparatus according to claim 1, wherein the developer bearer includes a driven gear disposed on a rotational shaft of the developer bearer, and wherein the driven gear meshes with a drive gear disposed on a rotational shaft of the latent image bearer.

3. The image forming apparatus according to claim 2, wherein a direction of a pressure angle of the driven gear is substantially perpendicular to a surface of the main reference portion of the attached and detached section.

4. The image forming apparatus according to claim 1, wherein the attached and detached section includes a guide rail configured to guide the main reference part during attachment and detachment of the attaching and detaching unit, and wherein the main reference portion includes a part of the guide rail.

5. The image forming apparatus according to claim 1, wherein a surface of the sub-reference portion of the attached and detached section is substantially parallel to a surface of the main reference portion of the attached and detached section.

6. The image forming apparatus according to claim 1, wherein a pressing direction of the pressing member is within a range of 10° or more and 30° or less with respect to a line connecting a rotational shaft of the latent image bearer and a rotational shaft of the developer bearer when viewed from a rotational axis direction of the latent image bearer.

7. The image forming apparatus according to claim 1, wherein the sub-reference part of the attaching and detaching unit has a curved surface.

8. The image forming apparatus according to claim 1, wherein the attached and detached section includes another main reference portion with a slight clearance between said another reference portion and the main reference part of the attaching and detaching unit.

9. The image forming apparatus according to claim 8, wherein said another main reference portion is parallel to the main reference portion.

10. A method of developing an image in an image forming apparatus, the method comprising:

developing a latent image on a latent image bearer with developer borne on a developer bearer of a developing device in an attaching and detaching unit;

attaching an attached and detached section including the latent image bearer to the attaching and detaching unit;

contacting a main reference portion to a main reference part of the attaching and detaching unit to position the attaching and detaching unit;

contacting a sub-reference portion to a sub-reference part of the attaching and detaching unit to receive a rotation of the attaching and detaching unit around the main reference part;

pressing a pressing member configured against the attaching and detaching unit to generate a biasing force biasing the developer bearer toward the latent image bearer and a rotational moment toward the sub-reference portion of the attached and detached section around the main reference part with respect to the attaching and detaching unit, wherein pressure of the pressing member against the attaching and detaching unit includes a force component generating the rotation moment and a force component parallel to a surface of the sub-reference portion, and wherein the force component parallel to the surface of the sub-reference portion is larger than the force component generating the rotation moment.

11. The method of claim 10, wherein the developer bearer includes a driven gear disposed on a rotational shaft of the developer bearer, and wherein the driven gear meshes with a drive gear disposed on a rotational shaft of the latent image bearer.

12. The method of claim 11, wherein a direction of a pressure angle of the driven uear is substantially perpendicular to a surface of the main reference portion of the attached and detached section.

13. The method of claim 10, wherein the attached and detached section includes a guide rail configured to guide the main reference part during attachment and detachment of the attaching and detaching unit, and wherein the main reference portion includes a part of the guide rail.

14. The method of claim 10, wherein a surface of the sub-reference portion of the attached and detached section is substantially parallel to a surface of the main reference portion of the attached and detached section.

* * * * *